US007918269B2

(12) United States Patent
Cavender et al.

(10) Patent No.: US 7,918,269 B2
(45) Date of Patent: Apr. 5, 2011

(54) DRAINAGE OF HEAVY OIL RESERVOIR VIA HORIZONTAL WELLBORE

(75) Inventors: Travis W. Cavender, Angleton, TX (US); Grant Hocking, London (GB); Roger L. Schultz, Ninnekah, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/625,302

(22) Filed: Nov. 24, 2009

(65) Prior Publication Data

US 2010/0071900 A1 Mar. 25, 2010

Related U.S. Application Data

(62) Division of application No. 11/832,620, filed on Aug. 1, 2007, now Pat. No. 7,647,966.

(51) Int. Cl.
*E21B 43/17* (2006.01)
*E21B 43/25* (2006.01)

(52) U.S. Cl. ..... 166/50; 166/52; 166/177.5; 166/207

(58) Field of Classification Search ..... None
See application file for complete search history.

(56) References Cited

U.S. PATENT DOCUMENTS

| | | | |
|---|---|---|---|
| 2,642,142 | A | 6/1953 | Clark |
| 2,687,179 | A | 8/1954 | Dismukes |
| 2,862,564 | A | 12/1958 | Bostock |
| 2,870,843 | A | 1/1959 | Rodgers, Jr. |
| 3,058,730 | A | 10/1962 | Bays |
| 3,062,286 | A | 11/1962 | Wyllie |
| 3,071,481 | A | 1/1963 | Beach et al. |
| 3,270,816 | A | 9/1966 | Staadt |
| 3,280,913 | A | 10/1966 | Smith |
| 3,338,317 | A | 8/1967 | Shore |
| 3,353,599 | A | 11/1967 | Swift |
| 3,690,380 | A | 9/1972 | Grable |
| 3,727,688 | A | 4/1973 | Clampitt |
| 3,779,915 | A | 12/1973 | Kucera |
| 3,884,303 | A | 5/1975 | Closmann |
| 3,948,325 | A | 4/1976 | Winston et al. |

(Continued)

FOREIGN PATENT DOCUMENTS

CA 2543886 A1 7/2005

(Continued)

OTHER PUBLICATIONS

Zhu, Wenlu; Montesi, Laurent G.J.; and Wong, Teng-fong; "Shear-enhanced compaction and permeability reduction: Triaxial extension tests on porous sandstone," Mechanics of Materials, Feb. 11, 1997, 16 pages.

(Continued)

*Primary Examiner* — George Suchfield
(74) *Attorney, Agent, or Firm* — Marlin R. Smith

(57) ABSTRACT

Systems and methods for drainage of a heavy oil reservoir via a horizontal wellbore. A method of improving production of fluid from a subterranean formation includes the step of propagating a generally vertical inclusion into the formation from a generally horizontal wellbore intersecting the formation. The inclusion is propagated into a portion of the formation having a bulk modulus of less than approximately 750,000 psi. A well system includes a generally vertical inclusion propagated into a subterranean formation from a generally horizontal wellbore which intersects the formation. The formation comprises weakly cemented sediment.

11 Claims, 5 Drawing Sheets

U.S. PATENT DOCUMENTS

| | | | | |
|---|---|---|---|---|
| 4,005,750 | A | 2/1977 | Shuck | |
| 4,018,293 | A | 4/1977 | Keller | |
| 4,311,194 | A | 1/1982 | White | |
| 4,834,181 | A | 5/1989 | Uhri et al. | |
| 4,977,961 | A | 12/1990 | Avasthi | |
| 5,010,964 | A | 4/1991 | Cornette | |
| 5,036,918 | A | 8/1991 | Jennings, Jr. et al. | |
| 5,103,911 | A | 4/1992 | Heijnen | |
| 5,105,886 | A * | 4/1992 | Strubhar et al. | 166/280.1 |
| 5,111,881 | A | 5/1992 | Soliman et al. | |
| 5,148,869 | A | 9/1992 | Sanchez | |
| 5,211,714 | A | 5/1993 | Jordan et al. | |
| 5,215,146 | A | 6/1993 | Sanchez | |
| 5,318,123 | A | 6/1994 | Venditto et al. | |
| 5,325,923 | A | 7/1994 | Surjaatmadja et al. | |
| 5,335,724 | A | 8/1994 | Venditto et al. | |
| 5,372,195 | A | 12/1994 | Swanson et al. | |
| 5,386,875 | A | 2/1995 | Venditto et al. | |
| 5,394,941 | A | 3/1995 | Venditto et al. | |
| 5,396,957 | A | 3/1995 | Surjaatmadja | |
| 5,431,225 | A | 7/1995 | Abass et al. | |
| 5,472,049 | A | 12/1995 | Chaffee et al. | |
| 5,494,103 | A | 2/1996 | Surjaatmadja et al. | |
| 5,547,023 | A | 8/1996 | McDaniel et al. | |
| 5,564,499 | A | 10/1996 | Willis et al. | |
| 5,667,011 | A | 9/1997 | Gill et al. | |
| 5,765,642 | A | 6/1998 | Surjaatmadja | |
| 5,829,520 | A | 11/1998 | Johnson | |
| 5,944,446 | A | 8/1999 | Hocking | |
| 5,981,447 | A | 11/1999 | Chang et al. | |
| 6,003,599 | A | 12/1999 | Huber et al. | |
| 6,116,343 | A | 9/2000 | Van Petegem et al. | |
| 6,142,229 | A | 11/2000 | Branson, Jr. et al. | |
| 6,176,313 | B1 | 1/2001 | Coenen et al. | |
| 6,216,783 | B1 | 4/2001 | Hocking et al. | |
| 6,283,216 | B1 | 9/2001 | Ohmer | |
| 6,330,914 | B1 | 12/2001 | Hocking et al. | |
| 6,443,227 | B1 | 9/2002 | Hocking et al. | |
| 6,446,727 | B1 | 9/2002 | Zemlak et al. | |
| 6,508,307 | B1 | 1/2003 | Almaguer | |
| 6,543,538 | B2 | 4/2003 | Tolman et al. | |
| 6,662,874 | B2 | 12/2003 | Surjaatmadja et al. | |
| 6,719,054 | B2 | 4/2004 | Cheng et al. | |
| 6,722,437 | B2 | 4/2004 | Vercaemer et al. | |
| 6,725,933 | B2 | 4/2004 | Middaugh et al. | |
| 6,732,800 | B2 | 5/2004 | Acock et al. | |
| 6,779,607 | B2 | 8/2004 | Middaugh et al. | |
| 6,782,953 | B2 | 8/2004 | MacGuire et al. | |
| 6,792,720 | B2 | 9/2004 | Hocking | |
| 6,991,037 | B2 | 1/2006 | Hocking | |
| 7,055,598 | B2 | 6/2006 | Ross et al. | |
| 7,066,284 | B2 | 6/2006 | Wylie et al. | |
| 7,069,989 | B2 | 7/2006 | Marmorshteyn et al. | |
| 7,228,908 | B2 | 6/2007 | East, Jr. et al. | |
| 7,240,728 | B2 | 7/2007 | Cook et al. | |
| 7,278,484 | B2 | 10/2007 | Vella et al. | |
| 7,412,331 | B2 | 8/2008 | Calhoun et al. | |
| 7,647,966 | B2 * | 1/2010 | Cavender et al. | 166/252.1 |
| 2002/0189818 | A1 | 12/2002 | Metcalfe | |
| 2003/0230408 | A1 | 12/2003 | Acock et al. | |
| 2004/0118574 | A1 | 6/2004 | Cook et al. | |
| 2005/0145387 | A1 * | 7/2005 | Hocking | 166/308.1 |
| 2005/0194143 | A1 | 9/2005 | Xu et al. | |
| 2005/0263284 | A1 | 12/2005 | Justus | |
| 2006/0131074 | A1 | 6/2006 | Calhoun et al. | |
| 2006/0144593 | A1 | 7/2006 | Reddy | |
| 2006/0162923 | A1 | 7/2006 | Ware | |
| 2007/0199695 | A1 | 8/2007 | Hocking | |
| 2007/0199697 | A1 | 8/2007 | Hocking | |
| 2007/0199698 | A1 | 8/2007 | Hocking | |
| 2007/0199699 | A1 | 8/2007 | Hocking | |
| 2007/0199700 | A1 | 8/2007 | Hocking | |
| 2007/0199701 | A1 | 8/2007 | Hocking | |
| 2007/0199702 | A1 | 8/2007 | Hocking | |
| 2007/0199704 | A1 | 8/2007 | Hocking | |
| 2007/0199705 | A1 | 8/2007 | Hocking | |
| 2007/0199706 | A1 | 8/2007 | Hocking | |
| 2007/0199707 | A1 | 8/2007 | Hocking | |
| 2007/0199708 | A1 | 8/2007 | Hocking | |
| 2007/0199710 | A1 | 8/2007 | Hocking | |
| 2007/0199711 | A1 | 8/2007 | Hocking | |
| 2007/0199712 | A1 | 8/2007 | Hocking | |
| 2007/0199713 | A1 | 8/2007 | Hocking | |
| 2009/0032267 | A1 | 2/2009 | Cavender et al. | |

FOREIGN PATENT DOCUMENTS

| | | | |
|---|---|---|---|
| EP | 1131534 | B1 | 9/2003 |
| WO | 8100016 | A1 | 1/1981 |
| WO | 0001926 | A1 | 1/2000 |
| WO | 0029716 | A2 | 5/2000 |
| WO | 2004092530 | A2 | 10/2004 |
| WO | 2005065334 | A2 | 7/2005 |
| WO | 2007100956 | A2 | 9/2007 |
| WO | 2007112175 | A2 | 10/2007 |
| WO | 2007112199 | A2 | 10/2007 |
| WO | 2007117787 | A2 | 10/2007 |
| WO | 2007117810 | A2 | 10/2007 |
| WO | 2007117865 | A2 | 10/2007 |

OTHER PUBLICATIONS

Karner, S.L., "What can granular media teach us about deformation in geothermal systems?" ARMA, Jun. 25-29, 2005, 12 pages, Idaho Falls, ID.

Coop, M.R., "The mechanics of uncemented carbonate sands," Geotechnique vol. 40, No. 4, 1990, pp. 607-625.

Coop, M.R., and Atkinson, J.H., "The mechanics of cemented carbonate sands," Geotechnique vol. 43, No. 1, 1993, pp. 53-67.

Cuccovillo, T., and Coop, M.R., "Yielding and pre-failure deformation of structured sands," Geotechnique vol. 47, No. 3, 1997, pp. 491-508.

Lockner, D.A., and Stanchits, S.A., "Undrained Poroelastic Response of Sandstones to Deviatoric Stress Change," Journal of Geophysical Research 107 (B12), 2002, 30 pages.

Kaselow, A., and Shapiro, S.A., "Stress sensitivity of elastic moduli and electrical resistivity in porous rocks," Journal of Geophysics and Engineering, 2004, 11 pages.

Lockner, D.A., and Beeler, N.M., "Stress-induced anisotropic poroelasticity response in sandstone," US Geological Survey, Jul. 16-18, 2003, 13 pages.

Rotta, G.V., Consoli, N.C., Prietto, P.D.M., Coop, M.R., and Graham, J., "Isotropic Yielding in an Artificially Cemented Soil Cured Under Stress," Geotechnique, vol. 53, No. 5, 2003, pp. 493-501.

Wong, T.F. and Baud, P., "Mechanical Compaction of Porous Sandstone," Oil & Gas Science and Technology, vol. 54, No. 6, 1999, pp. 715-727.

U.S. Appl. No. 11/545,749, filed Oct. 10, 2006.

U.S. Appl. No. 11/610,819, filed Dec. 14, 2006.

U.S. Appl. No. 11/753,314, filed May 24, 2007.

U.S. Appl. No. 11/832,602, filed Aug. 1, 2007.

U.S. Appl. No. 11/832,615, filed Aug. 1, 2007.

U.S. Appl. No. 11/966,212, filed Dec. 28, 2007.

U.S. Appl. No. 11/977,772, filed Oct. 26, 2007.

International Search Report and Written Opinion issued Sep. 25, 2008, for International Patent Application Serial No. PCT/US07/87291, 11 pages.

International Search Report and Written Opinion issued Oct. 8, 2008, for International Patent Application Serial No. PCT/US08/70780, 8 pages.

International Search Report and Written Opinion issued Jan. 2, 2009, for International Patent Application Serial No. PCT/US08/70776, 11 pages.

Office Action issued Jan. 26, 2009, for U.S. Appl. No. 11/832,615, 23 pages.

Office Action issued Feb. 2, 2009, for Canadian Patent Application Serial No. 2,596,201, 3 pages.

Office Action issued May 15, 2009, for U.S. Appl. No. 11/610,819, 26 pages.

Office Action issued Jun. 16, 2009, for U.S. Appl. No. 11/832,602, 37 pages.

Office Action issued Sep. 24, 2009, for U.S. Appl. No. 11/966,212, 37 pages.

Office Action issued Sep. 29, 2009, for U.S. Appl. No. 11/610,819, 12 pages.
Office Action issued Jan. 21, 2010, for U.S. Appl. No. 11/610,819, 11 pages.
Halliburton Retrievable Service Tools, Cobra Frac® RR4-EV Packer, undated, 2 pages.
Halliburton Production Optimization Cobra Frac® Service product brochure H02319, Aug. 2005, 2 pages.
Halliburton Drawing No. D00004932, Sep. 10, 1999, 2 pages.
Serata Geomechanics Corporation, "Stress/Property Measurements for Geotechnics," 2005-2007, 11 pages.
ISTT, "Tenchless Pipe Replacement," Dec. 11, 2006, 1 page.
STAR Frac Completion System Frac Casing Newsletting, Winter/Spring 2006, 4 pages.
International Search Report and Written Opinion issued Jul. 2, 2010, for International Patent Application Serial No. PCT/US09/063588, 11 pages.
Invitation to Pay Additional Fees issued May 12, 2010, for International Patent Application Serial No. PCT/US09/063588, 4 pages.
International Preliminary Report on Patentability issued Jul. 8, 2010, for International Patent Application Serial No. PCT/US08/087346, 8 pages.
Official Action issued for Russian Patent Application No. 2010107229, 3 pages.

* cited by examiner

DRAINAGE OF HEAVY OIL RESERVOIR VIA HORIZONTAL WELLBORE

CROSS-REFERENCE TO RELATED APPLICATION

This application is a division of prior application Ser. No. 11/832,620 filed on Aug. 1, 2007. The entire disclosure of this prior application is incorporated herein by this reference.

BACKGROUND

The present invention relates generally to equipment utilized and operations performed in conjunction with a subterranean well and, in an embodiment described herein, more particularly provides drainage of a heavy oil reservoir via a generally horizontal wellbore.

It is well known that extensive heavy oil reservoirs are found in formations comprising unconsolidated, weakly cemented sediments. Unfortunately, the methods currently used for extracting the heavy oil from these formations have not produced entirely satisfactory results.

Heavy oil is not very mobile in these formations, and so it would be desirable to be able to form increased permeability planes in the formations. The increased permeability planes would increase the mobility of the heavy oil in the formations and/or increase the effectiveness of steam or solvent injection, in situ combustion, etc.

However, techniques used in hard, brittle rock to form fractures therein are typically not applicable to ductile formations comprising unconsolidated, weakly cemented sediments. Therefore, it will be appreciated that improvements are needed in the art of draining heavy oil from unconsolidated, weakly cemented formations.

SUMMARY

In carrying out the principles of the present invention, well systems and methods are provided which solve at least one problem in the art. One example is described below in which an inclusion is propagated into a formation comprising weakly cemented sediment. Another example is described below in which the inclusion facilitates production from the formation into a generally horizontal wellbore.

In one aspect, a method of improving production of fluid from a subterranean formation is provided. The method includes the step of propagating a generally vertical inclusion into the formation from a generally horizontal wellbore intersecting the formation. The inclusion is propagated into a portion of the formation having a bulk modulus of less than approximately 750,000 psi.

In another aspect, a well system is provided which includes a generally vertical inclusion propagated into a subterranean formation from a generally horizontal wellbore which intersects the formation. The formation comprises weakly cemented sediment.

These and other features, advantages, benefits and objects will become apparent to one of ordinary skill in the art upon careful consideration of the detailed description of representative embodiments of the invention herein below and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

Figure 1:
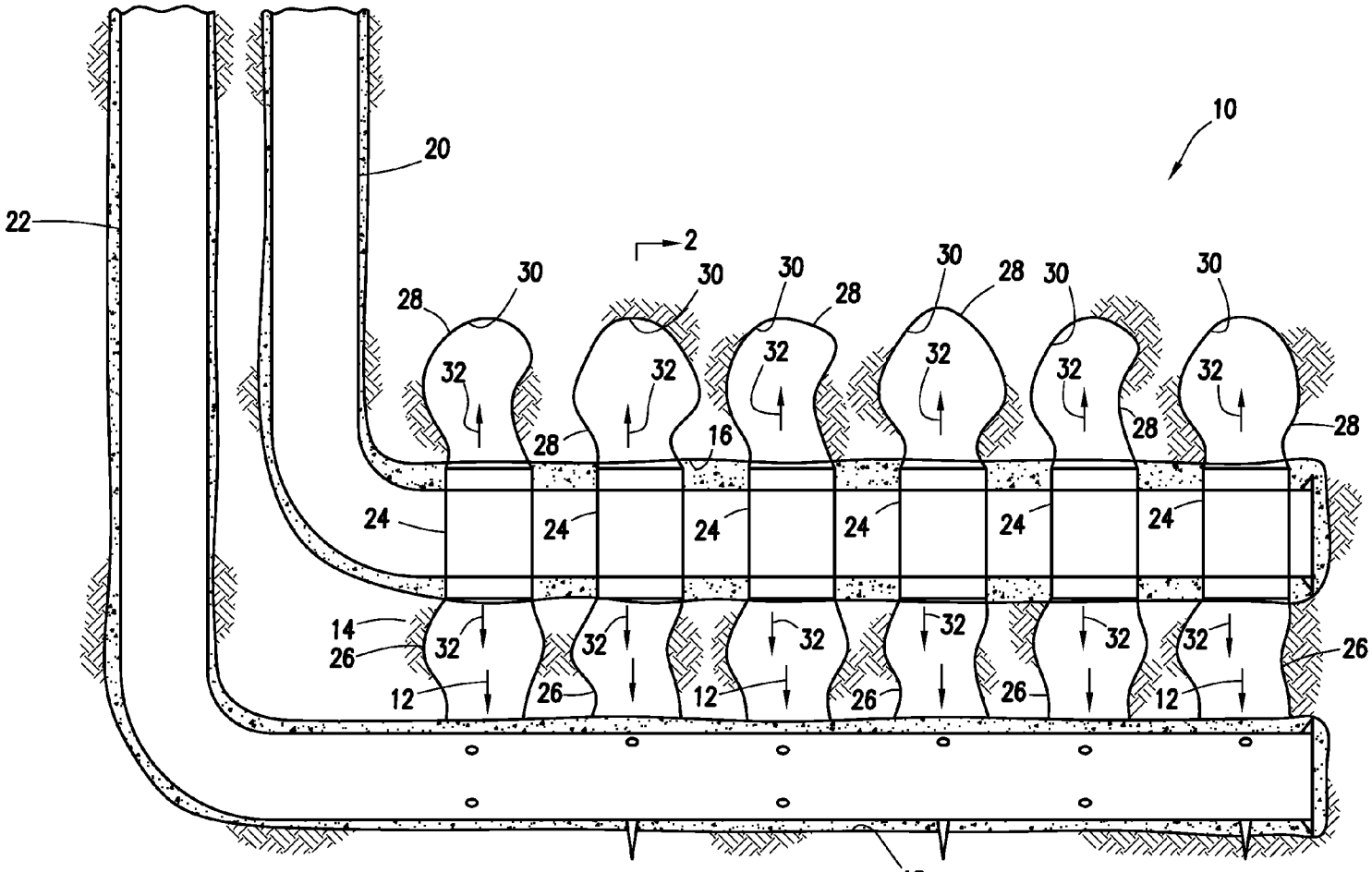
FIG. 1 is a schematic partially cross-sectional view of a well system and associated method embodying principles of the present invention.

Representatively illustrated in FIG. 1 is a well system 10 and associated method which embody principles of the present invention. The system 10 is particularly useful for producing heavy oil 12 from a formation 14. The formation 14 may comprise unconsolidated and/or weakly cemented sediments for which conventional fracturing operations are not well suited.

The term "heavy oil" is used herein to indicate relatively high viscosity and high density hydrocarbons, such as bitumen. Heavy oil is typically not recoverable in its natural state (e.g., without heating or diluting) via wells, and may be either mined or recovered via wells through use of steam and solvent injection, in situ combustion, etc. Gas-free heavy oil generally has a viscosity of greater than 100 centipoise and a density of less than 20 degrees API gravity (greater than about 900 kilograms/cubic meter).

As depicted in FIG. 1, two generally horizontal wellbores 16, 18 have been drilled into the formation 14. Two casing strings 20, 22 have been installed and cemented in the respective wellbores 16, 18.

The term "casing" is used herein to indicate a protective lining for a wellbore. Any type of protective lining may be used, including those known to persons skilled in the art as liner, casing, tubing, etc. Casing may be segmented or continuous, jointed or unjointed, made of any material (such as steel, aluminum, polymers, composite materials, etc.), and may be expanded or unexpanded, etc.

Note that it is not necessary for either or both of the casing strings 20, 22 to be cemented in the wellbores 16, 18. For example, one or both of the wellbores 16, 18 could be uncemented or "open hole" in the portions of the wellbores intersecting the formation 14.

Preferably, at least the casing string 20 is cemented in the upper wellbore 16 and has expansion devices 24 interconnected therein. The expansion devices 24 operate to expand the casing string 20 radially outward and thereby dilate the formation 14 proximate the devices, in order to initiate forming of generally vertical and planar inclusions 26, 28 extending outwardly from the wellbore 16.

Suitable expansion devices for use in the well system 10 are described in U.S. Pat. Nos. 6,991,037, 6,792,720, 6,216,783, 6,330,914, 6,443,227 and their progeny, and in U.S.

patent application Ser. No. 11/610,819. The entire disclosures of these prior patents and patent applications are incorporated herein by this reference. Other expansion devices may be used in the well system 10 in keeping with the principles of the invention.

Once the devices 24 are operated to expand the casing string 20 radially outward, fluid is forced into the dilated formation 14 to propagate the inclusions 26, 28 into the formation. It is not necessary for the inclusions 26, 28 to be formed simultaneously or for all of the upwardly or downwardly extending inclusions to be formed together.

The formation 14 could be comprised of relatively hard and brittle rock, but the system 10 and method find especially beneficial application in ductile rock formations made up of unconsolidated or weakly cemented sediments, in which it is typically very difficult to obtain directional or geometric control over inclusions as they are being formed.

Weakly cemented sediments are primarily frictional materials since they have minimal cohesive strength. An uncemented sand having no inherent cohesive strength (i.e., no cement bonding holding the sand grains together) cannot contain a stable crack within its structure and cannot undergo brittle fracture. Such materials are categorized as frictional materials which fail under shear stress, whereas brittle cohesive materials, such as strong rocks, fail under normal stress.

The term "cohesion" is used in the art to describe the strength of a material at zero effective mean stress. Weakly cemented materials may appear to have some apparent cohesion due to suction or negative pore pressures created by capillary attraction in fine grained sediment, with the sediment being only partially saturated. These suction pressures hold the grains together at low effective stresses and, thus, are often called apparent cohesion.

The suction pressures are not true bonding of the sediment's grains, since the suction pressures would dissipate due to complete saturation of the sediment. Apparent cohesion is generally such a small component of strength that it cannot be effectively measured for strong rocks, and only becomes apparent when testing very weakly cemented sediments.

Geological strong materials, such as relatively strong rock, behave as brittle materials at normal petroleum reservoir depths, but at great depth (i.e. at very high confining stress) or at highly elevated temperatures, these rocks can behave like ductile frictional materials. Unconsolidated sands and weakly cemented formations behave as ductile frictional materials from shallow to deep depths, and the behavior of such materials are fundamentally different from rocks that exhibit brittle fracture behavior. Ductile frictional materials fail under shear stress and consume energy due to frictional sliding, rotation and displacement.

Conventional hydraulic dilation of weakly cemented sediments is conducted extensively on petroleum reservoirs as a means of sand control. The procedure is commonly referred to as "Frac-and-Pack." In a typical operation, the casing is perforated over the formation interval intended to be fractured and the formation is injected with a treatment fluid of low gel loading without proppant, in order to form the desired two winged structure of a fracture. Then, the proppant loading in the treatment fluid is increased substantially to yield tip screen-out of the fracture. In this manner, the fracture tip does not extend further, and the fracture and perforations are backfilled with proppant.

The process assumes a two winged fracture is formed as in conventional brittle hydraulic fracturing. However, such a process has not been duplicated in the laboratory or in shallow field trials. In laboratory experiments and shallow field trials what has been observed is chaotic geometries of the injected fluid, with many cases evidencing cavity expansion growth of the treatment fluid around the well and with deformation or compaction of the host formation.

Weakly cemented sediments behave like a ductile frictional material in yield due to the predominantly frictional behavior and the low cohesion between the grains of the sediment. Such materials do not "fracture" and, therefore, there is no inherent fracturing process in these materials as compared to conventional hydraulic fracturing of strong brittle rocks.

Linear elastic fracture mechanics is not generally applicable to the behavior of weakly cemented sediments. The knowledge base of propagating viscous planar inclusions in weakly cemented sediments is primarily from recent experience over the past ten years and much is still not known regarding the process of viscous fluid propagation in these sediments.

However, the present disclosure provides information to enable those skilled in the art of hydraulic fracturing, soil and rock mechanics to practice a method and system 10 to initiate and control the propagation of a viscous fluid in weakly cemented sediments. The viscous fluid propagation process in these sediments involves the unloading of the formation in the vicinity of the tip 30 of the propagating viscous fluid 32, causing dilation of the formation 14, which generates pore pressure gradients towards this dilating zone. As the formation 14 dilates at the tips 30 of the advancing viscous fluid 32, the pore pressure decreases dramatically at the tips, resulting in increased pore pressure gradients surrounding the tips.

The pore pressure gradients at the tips 30 of the inclusions 26, 28 result in the liquefaction, cavitation (degassing) or fluidization of the formation 14 immediately surrounding the tips. That is, the formation 14 in the dilating zone about the tips 30 acts like a fluid since its strength, fabric and in situ stresses have been destroyed by the fluidizing process, and this fluidized zone in the formation immediately ahead of the viscous fluid 32 propagating tip 30 is a planar path of least resistance for the viscous fluid to propagate further. In at least this manner, the system 10 and associated method provide for directional and geometric control over the advancing inclusions 26, 28.

The behavioral characteristics of the viscous fluid 32 are preferably controlled to ensure the propagating viscous fluid does not overrun the fluidized zone and lead to a loss of control of the propagating process. Thus, the viscosity of the fluid 32 and the volumetric rate of injection of the fluid should be controlled to ensure that the conditions described above persist while the inclusions 26, 28 are being propagated through the formation 14.

For example, the viscosity of the fluid 32 is preferably greater than approximately 100 centipoise. However, if foamed fluid 32 is used in the system 10 and method, a greater range of viscosity and injection rate may be permitted while still maintaining directional and geometric control over the inclusions 26, 28.

The system 10 and associated method are applicable to formations of weakly cemented sediments with low cohesive strength compared to the vertical overburden stress prevailing at the depth of interest. Low cohesive strength is defined herein as no greater than 400 pounds per square inch (psi) plus 0.4 times the mean effective stress (p') at the depth of propagation.

$$c<400\text{ psi}+0.4p' \quad (1)$$

where c is cohesive strength and p' is mean effective stress in the formation 14.

Examples of such weakly cemented sediments are sand and sandstone formations, mudstones, shales, and siltstones, all of which have inherent low cohesive strength. Critical state soil mechanics assists in defining when a material is behaving as a cohesive material capable of brittle fracture or when it behaves predominantly as a ductile frictional material.

Weakly cemented sediments are also characterized as having a soft skeleton structure at low effective mean stress due to the lack of cohesive bonding between the grains. On the other hand, hard strong stiff rocks will not substantially decrease in volume under an increment of load due to an increase in mean stress.

In the art of poroelasticity, the Skempton B parameter is a measure of a sediment's characteristic stiffness compared to the fluid contained within the sediment's pores. The Skempton B parameter is a measure of the rise in pore pressure in the material for an incremental rise in mean stress under undrained conditions.

In stiff rocks, the rock skeleton takes on the increment of mean stress and thus the pore pressure does not rise, i.e., corresponding to a Skempton B parameter value of at or about 0. But in a soft soil, the soil skeleton deforms easily under the increment of mean stress and, thus, the increment of mean stress is supported by the pore fluid under undrained conditions (corresponding to a Skempton B parameter of at or about 1).

The following equations illustrate the relationships between these parameters:

$$\Delta u = B\Delta p \tag{2}$$

$$B = (K_u - K)/(\alpha K_u) \tag{3}$$

$$\alpha = 1 - (K/K_s) \tag{4}$$

where $\Delta u$ is the increment of pore pressure, B the Skempton B parameter, $\Delta p$ the increment of mean stress, $K_u$ is the undrained formation bulk modulus, K the drained formation bulk modulus, $\alpha$ is the Biot-Willis poroelastic parameter, and $K_s$ is the bulk modulus of the formation grains. In the system 10 and associated method, the bulk modulus K of the formation 14 is preferably less than approximately 750,000 psi.

For use of the system 10 and method in weakly cemented sediments, preferably the Skempton B parameter is as follows:

$$B > 0.95\exp(-0.04p') + 0.008p' \tag{5}$$

The system 10 and associated method are applicable to formations of weakly cemented sediments (such as tight gas sands, mudstones and shales) where large entensive propped vertical permeable drainage planes are desired to intersect thin sand lenses and provide drainage paths for greater gas production from the formations. In weakly cemented formations containing heavy oil (viscosity>100 centipoise) or bitumen (extremely high viscosity>100,000 centipoise), generally known as oil sands, propped vertical permeable drainage planes provide drainage paths for cold production from these formations, and access for steam, solvents, oils, and heat to increase the mobility of the petroleum hydrocarbons and thus aid in the extraction of the hydrocarbons from the formation. In highly permeable weak sand formations, permeable drainage planes of large lateral length result in lower drawdown of the pressure in the reservoir, which reduces the fluid gradients acting towards the wellbore, resulting in less drag on fines in the formation, resulting in reduced flow of formation fines into the wellbore.

Although the present invention contemplates the formation of permeable drainage paths which generally extend laterally away from a horizontal or near horizontal wellbore 16 penetrating an earth formation 14 and generally in a vertical plane in opposite directions from the wellbore, those skilled in the art will recognize that the invention may be carried out in earth formations wherein the permeable drainage paths can extend in directions other than vertical, such as in inclined or horizontal directions. Furthermore, it is not necessary for the planar inclusions 26, 28 to be used for drainage, since in some circumstances it may be desirable to use the planar inclusions exclusively for injecting fluids into the formation 14, for forming an impermeable barrier in the formation, etc.

Figure 2:
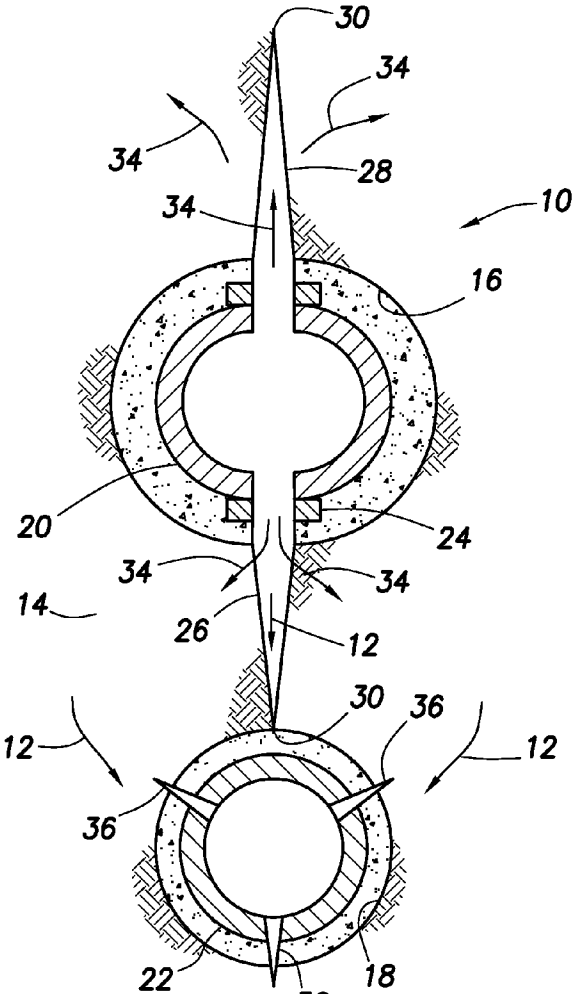
FIG. 2 is an enlarged scale schematic cross-sectional view through the well system, taken along line 2-2 of FIG. 1.

An enlarged scale cross-sectional view of the well system 10 is representatively illustrated in FIG. 2. This view depicts the system 10 after the inclusions 26, 28 have been formed and the heavy oil 12 is being produced from the formation 14.

Note that the inclusions 26 extending downwardly from the upper wellbore 16 and toward the lower wellbore 18 may be used both for injecting fluid 34 into the formation 14 from the upper wellbore, and for producing the heavy oil 12 from the formation into the lower wellbore. The injected fluid 34 could be steam, solvent, fuel for in situ combustion, or any other type of fluid for enhancing mobility of the heavy oil 12.

The heavy oil 12 is received in the lower wellbore 18, for example, via perforations 36 if the casing string 22 is cemented in the wellbore. Alternatively, the casing string 22 could be a perforated or slotted liner which is gravel-packed in an open portion of the wellbore 18, etc. However, it should be clearly understood that the invention is not limited to any particular means or configuration of elements in the wellbores 16, 18 for injecting the fluid 34 into the formation 14 or recovering the heavy oil 12 from the formation.

Figure 3:
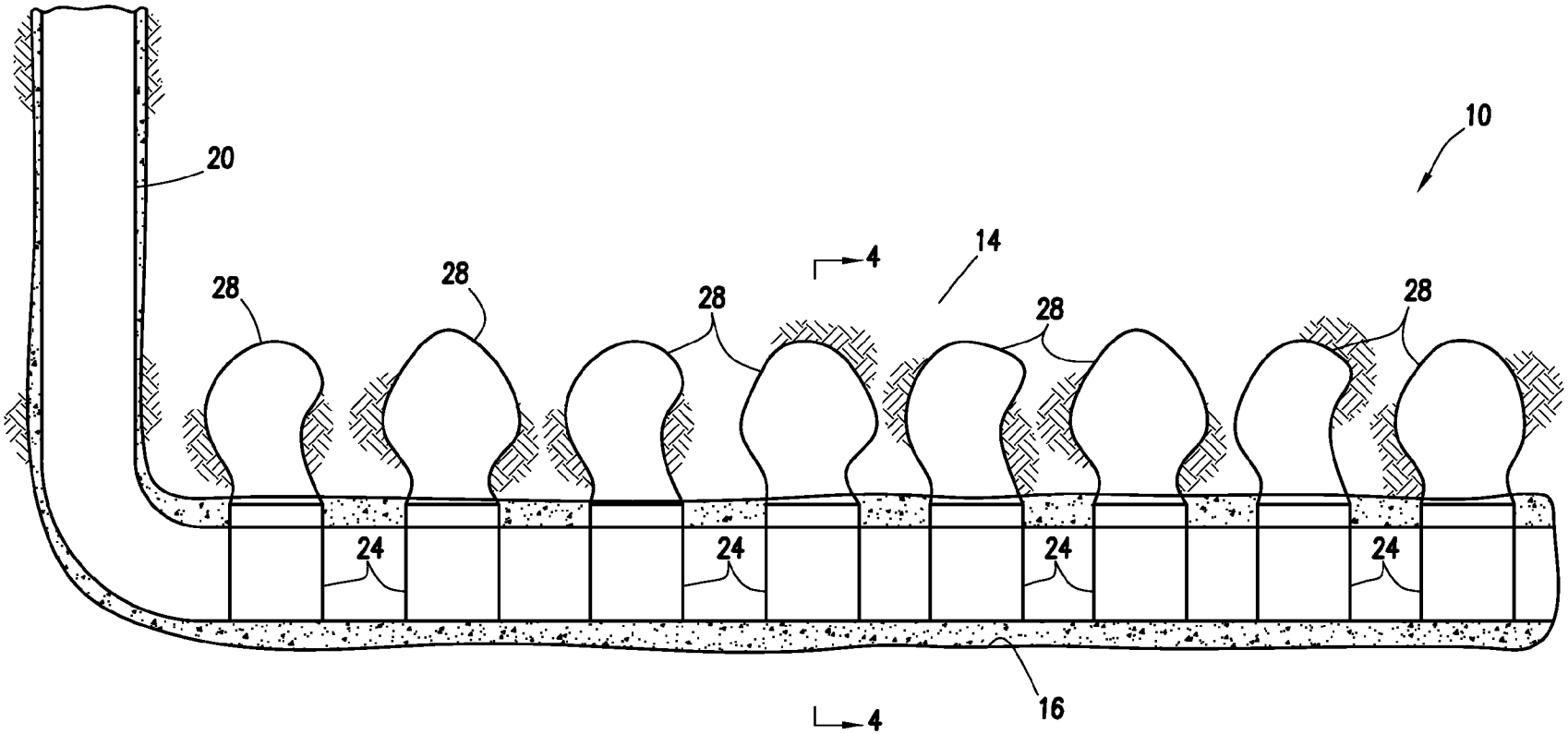
FIG. 3 is a schematic partially cross-sectional view of an alternate configuration of the well system.

Referring additionally now to FIG. 3, an alternate configuration of the well system 10 is representatively illustrated. In this configuration, the lower wellbore 18 and the inclusions 26 are not used. Instead, the expansion devices 24 are used to facilitate initiation and propagation of the upwardly extending inclusions 28 into the formation 14.

Figure 4:
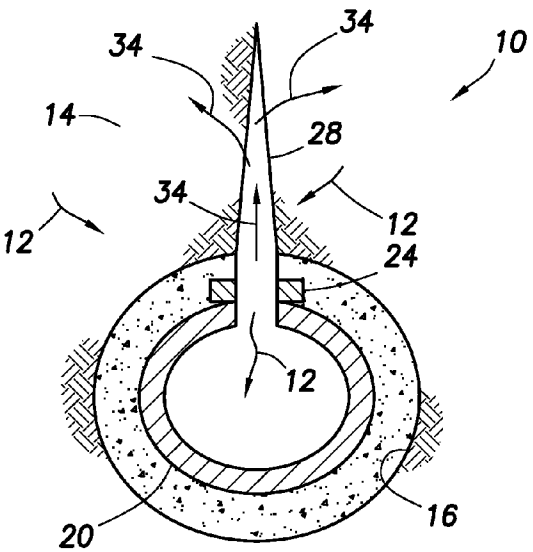
FIG. 4 is an enlarged scale schematic cross-sectional view through the alternate configuration of the well system, taken along line 4-4 of FIG. 3.

An enlarged scale cross-sectional view of the well system 10 configuration of FIG. 3 is representatively illustrated in FIG. 4. In this view it may be seen that the inclusions 28 may be used to inject the fluid 34 into the formation 14 and/or to produce the heavy oil 12 from the formation into the wellbore 16.

Note that the devices 24 as depicted in FIGS. 3 & 4 are somewhat different from the devices depicted in FIGS. 1 & 2. In particular, the device 24 illustrated in FIG. 4 has only one dilation opening for zero degree phasing of the resulting inclusions 28, whereas the device 24 illustrated in FIG. 2 has two dilation openings for 180 degree relative phasing of the inclusions 26, 28.

However, it should be understood that any phasing or combination of relative phasings may be used in the various configurations of the well system 10 described herein, without departing from the principles of the invention. For example, the well system 10 configuration of FIGS. 3 & 4 could include the expansion devices 24 having 180 degree relative phasing, in which case both the upwardly and downwardly extending inclusions 26, 28 could be formed in this configuration.

Figure 5A:
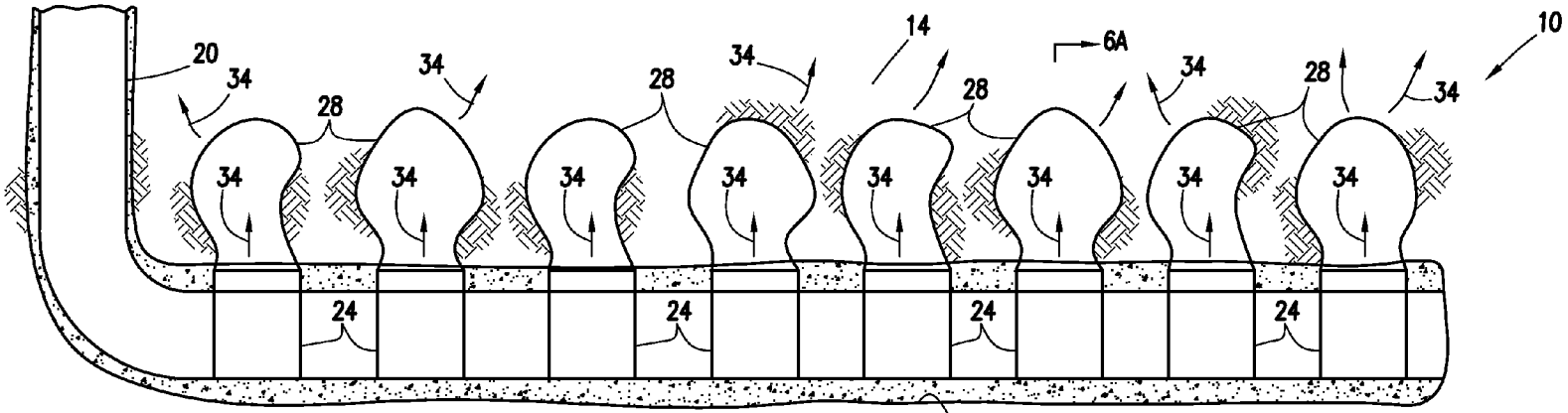
FIGS. 5A & B are schematic partially cross-sectional views of another alternate configuration of the well system, with fluid injection being depicted in FIG. 5A, and fluid production being depicted in FIG. 5B.
Figure 5B:
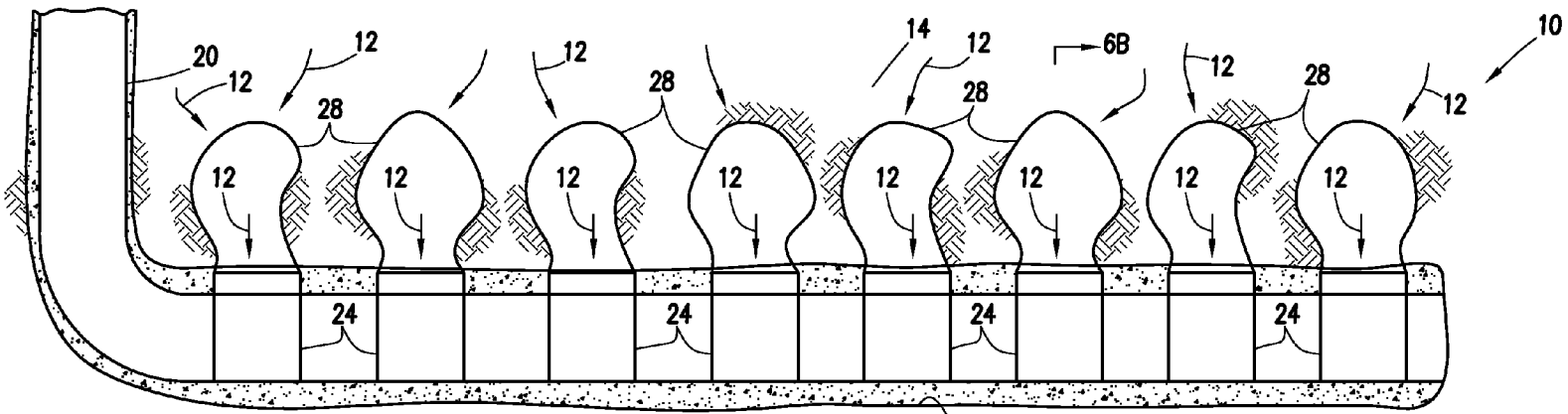

Referring additionally now to FIGS. 5A & B, another alternate configuration of the well system 10 is representatively illustrated. This configuration is similar in many respects to the configuration of FIG. 3. However, in this version of the well system 10, the inclusions 28 are alternately used for injecting the fluid 34 into the formation 14 (as depicted in FIG. 5A) and producing the heavy oil 12 from the formation into the wellbore 16 (as depicted in FIG. 5B).

For example, the fluid 34 could be steam which is injected into the formation 14 for an extended period of time to heat the heavy oil 12 in the formation. At an appropriate time, the steam injection is ceased and the heated heavy oil 12 is produced into the wellbore 16. Thus, the inclusions 28 are used both for injecting the fluid 34 into the formation 14, and for producing the heavy oil 12 from the formation.

Figure 6B:
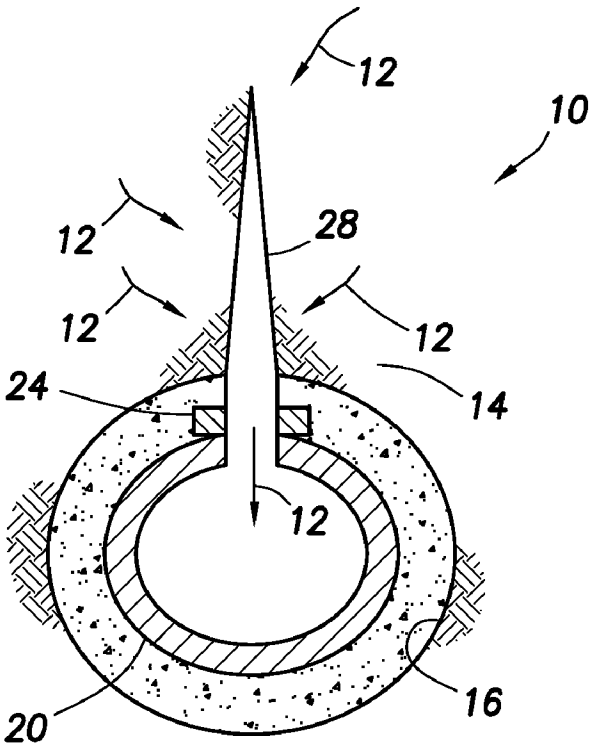
FIGS. 6A & B are enlarged scale schematic cross-sectional views of the well system, taken along respective lines 6A-6A and 6B-6B of FIGS. 5A & B.
Figure 6A:
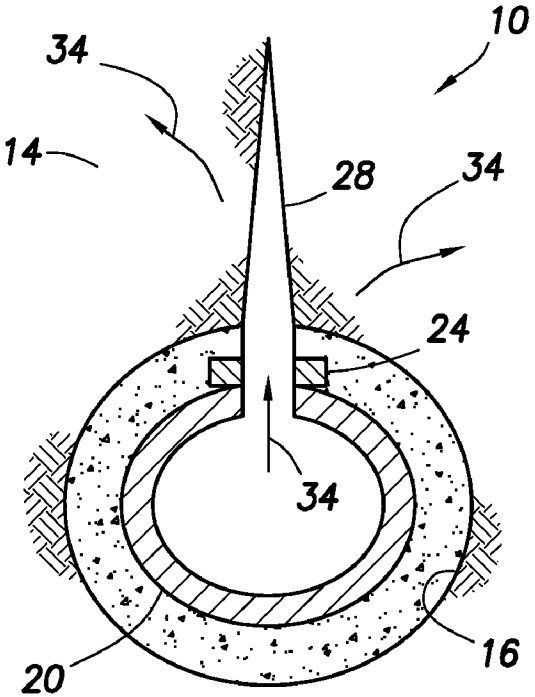

A cross-sectional view of the well system 10 of FIG. 5A during the injection operation is representatively illustrated in FIG. 6A. Another cross-sectional view of the well system 10 of FIG. 5B during the production operation is representatively illustrated in FIG. 6B.

As discussed above for the well system 10 configuration of FIG. 3, any phasing or combination of relative phasings may be used for the devices 24 in the well system of FIGS. 5A-6B. In addition, the downwardly extending inclusions 26 may be formed in the well system 10 of FIGS. 5A-6B.

Although the various configurations of the well system 10 have been described above as being used for recovery of heavy oil 12 from the formation 14, it should be clearly understood that other types of fluids could be produced using the well systems and associated methods incorporating principles of the present invention. For example, petroleum fluids having lower densities and viscosities could be produced without departing from the principles of the present invention.

It may now be fully appreciated that the above detailed description provides a well system 10 and associated method for improving production of fluid (such as heavy oil 12) from a subterranean formation 14. The method includes the step of propagating one or more generally vertical inclusions 26, 28 into the formation 14 from a generally horizontal wellbore 16 intersecting the formation. The inclusions 26, 28 are preferably propagated into a portion of the formation 14 having a bulk modulus of less than approximately 750,000 psi.

The well system 10 preferably includes the generally vertical inclusions 26, 28 propagated into the subterranean formation 14 from the wellbore 16 which intersects the formation. The formation 14 may comprise weakly cemented sediment.

The inclusions 28 may extend above the wellbore 16. The method may also include propagating another generally vertical inclusion 26 into the formation 14 below the wellbore 16. The steps of propagating the inclusions 26, 28 may be performed simultaneously, or the steps may be separately performed.

The inclusions 26 may be propagated in a direction toward a second generally horizontal wellbore 18 intersecting the formation 14. A fluid 34 may be injected into the formation 14 from the wellbore 16, and another fluid 12 may be produced from the formation into the wellbore 18.

The propagating step may include propagating the inclusions 26 toward the generally horizontal wellbore 18 intersecting the formation 14. The method may include the step of radially outwardly expanding casings 20, 22 in the respective wellbores 16, 18.

The method may include the steps of alternately injecting a fluid 34 into the formation 14 from the wellbore 16, and producing another fluid 12 from the formation into the wellbore.

The propagating step may include reducing a pore pressure in the formation 14 at tips 30 of the inclusions 26, 28 during the propagating step. The propagating step may include increasing a pore pressure gradient in the formation 14 at tips 30 of the inclusions 26, 28.

The formation 14 portion may comprise weakly cemented sediment. The propagating step may include fluidizing the formation 14 at tips 30 of the inclusions 26, 28. The formation 14 may have a cohesive strength of less than 400 pounds per square inch plus 0.4 times a mean effective stress in the formation at the depth of the inclusions 26, 28. The formation 14 may have a Skempton B parameter greater than $0.95\exp(-0.04\,p')+0.008\,p'$, where $p'$ is a mean effective stress at a depth of the inclusions 26, 28.

The propagating step may include injecting a fluid 32 into the formation 14. A viscosity of the fluid 32 in the fluid injecting step may be greater than approximately 100 centipoise.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A well system, comprising:

a substantially vertical first inclusion propagated into a subterranean formation from a substantially horizontal first wellbore which intersects the formation, the formation having a Skempton B parameter greater than $0.95\exp(-0.04\,p')+0.008\,p'$, where $p'$ is a mean effective stress at a depth of the first inclusion.

2. The well system of claim 1, wherein the first inclusion is propagated into a portion of the formation having a bulk modulus of less than approximately 750,000 psi.

3. The well system of claim 1, wherein the first inclusion extends upwardly from the first wellbore.

4. The well system of claim 3, further comprising a substantially vertical second inclusion propagated into the formation and extending downwardly from the first wellbore.

5. The well system of claim 4, wherein the second inclusion extends in a direction toward a second substantially horizontal wellbore intersecting the formation.

6. The well system of claim 5, further comprising a first fluid injected into the formation from the first wellbore, and a second fluid produced from the formation into the second wellbore.

7. The well system of claim 1, wherein the first inclusion extends toward a second substantially horizontal wellbore intersecting the formation.

8. The well system of claim 1, further comprising a first fluid injected into the formation from the first wellbore, and a second fluid produced from the formation into the first wellbore.

9. The well system of claim 8, wherein the first fluid injection alternates with the second fluid production.

10. The well system of claim 1, wherein the formation has a cohesive strength of less than a sum of 400 pounds per square inch and 0.4 times a mean effective stress in the formation at the depth of the first inclusion.

11. The well system of claim 1, further comprising a radially outwardly expanded casing in the first wellbore.

* * * * *